US008373067B2

(12) United States Patent
Derda et al.

(10) Patent No.: US 8,373,067 B2
(45) Date of Patent: Feb. 12, 2013

(54) ELECTRICAL CONNECTOR

(75) Inventors: Martin Derda, Bochum (DE); Peter Paulus, Muenster (DE); Michael Buescher, Bochum (DE)

(73) Assignee: Pilkington Automotive Deutschland GmbH, Witten (DE)

( * ) Notice: Subject to any disclaimer, the term of this patent is extended or adjusted under 35 U.S.C. 154(b) by 331 days.

(21) Appl. No.: 12/670,614

(22) PCT Filed: Jul. 2, 2008

(86) PCT No.: PCT/EP2008/058518

§ 371 (c)(1),
(2), (4) Date: Jan. 25, 2010

(87) PCT Pub. No.: WO2009/015975

PCT Pub. Date: Feb. 5, 2009

(65) Prior Publication Data

US 2010/0193242 A1 Aug. 5, 2010

(30) Foreign Application Priority Data

Jul. 30, 2007 (GB) ..... 0714723.4

(51) Int. Cl.
*H01R 4/02* (2006.01)
*H01R 4/58* (2006.01)

(52) U.S. Cl. ..... 174/88 R; 174/84 R; 174/68.1

(58) Field of Classification Search ..... 174/88 R, 174/68.1, 84 R; 361/760, 771, 772
See application file for complete search history.

(56) References Cited

U.S. PATENT DOCUMENTS 4,433,223 A * 2/1984 Larson et al. ..... 200/512
4,433,887 A * 2/1984 Sado et al. ..... 439/83
4,589,584 A * 5/1986 Christiansen et al. ..... 228/111.5
4,735,847 A * 4/1988 Fujiwara et al. ..... 428/209
5,041,183 A * 8/1991 Nakamura et al. ..... 156/264
(Continued)

FOREIGN PATENT DOCUMENTS

EP 0 413 614 A2 2/1991
EP 0 535 491 A1 4/1993
(Continued)

OTHER PUBLICATIONS

Search Report issued Nov. 19, 2007 by the UK Intellectual Property Office in UK Patent Application No. GB0714723.4.

(Continued)

*Primary Examiner* — Angel R Estrada
*Assistant Examiner* — Dimary Lopez
(74) *Attorney, Agent, or Firm* — Buchanan Ingersoll & Rooney PC

(57) ABSTRACT

An electrical connector comprising a connector body having first and second connection portions and two or more electrical pathways provided within the connector body between the first and second connection portions, the first connection portion having a functional surface on which at least two exposed areas of conductive material are provided, each of which is in contact with a corresponding electrical pathway, for connection to an electrical element on a substrate, wherein adhesive is provided on the functional surface such that, at a minimum, a peripheral band is formed around each of the areas of conductive material for adhesion to the substrate. Also a glazing comprising at least one pane of glazing material provided with an electrical element, and an electrical connector as described above electrically connected to the electrical element and adhered to a surface of the glazing.

19 Claims, 2 Drawing Sheets

U.S. PATENT DOCUMENTS

| | | | | |
|---|---|---|---|---|
| 5,155,301 | A | 10/1992 | Mase | |
| 5,920,125 | A * | 7/1999 | Ellerson et al. | 257/778 |
| 6,307,515 | B1 * | 10/2001 | Sauer et al. | 343/713 |
| 6,717,819 | B1 | 4/2004 | Chung | |
| 8,058,951 | B2 * | 11/2011 | Yamamoto et al. | 333/185 |
| 2008/0156437 | A1 | 7/2008 | Kawate et al. | |

FOREIGN PATENT DOCUMENTS

| | | | |
|---|---|---|---|
| EP | 1 439 600 | A2 | 7/2004 |
| EP | 1439600 | A2 * | 7/2004 |
| WO | WO 00/64229 | A1 | 10/2000 |
| WO | WO 2006/096631 | A1 | 9/2006 |

OTHER PUBLICATIONS

International Search Report issued on Sep. 11, 2008 by the European Patent Office as the International Searching Authority in International Application No. PCT/EP2008/058518.

* cited by examiner

ELECTRICAL CONNECTOR

The present invention relates to an improved electrical connector, and to a glazing comprising such a connector.

In the art there are very many electrical connectors, which are used to connect (directly or indirectly) many different types of electrical elements to a source of electrical power. In the field of glazings, especially vehicle glazings, one such example of an electrical connector is described in EP 1 439 600 A2 which is suitable for connecting connection points (conducting tracks) comprised in a vehicle glazing to the battery of a vehicle into which the glazing may be fitted, so that electrical power may be provided to the connection points.

The electrical connector of EP '600 is constructed from two insulating layers which lie adjacent and parallel to one another and which form the connector body. At one end of the body there is a connection zone where a number of metallic contacts, for example blobs of solder, are located. Each contact is electrically connected to an individual metallic conducting track; the conducting tracks extend between the insulating layers to the other end of the connector body to a hub for connection to a vehicle's power supply.

Both insulating layers are made of the same material, for example a pressure-resistant polyimide material such as Kapton™, and have the same dimensions. However in the connection zone, one layer is provided with a number of apertures to accommodate the metallic contacts. Prior to connection to a glazing, each of the contacts protrudes from its aperture to enable their subsequent positioning on, and connection to, the connection points.

To apply the connector to the connection points of the glazing, a heating tool is typically pressed against the connector on the opposite side to, and in the region of, the metallic contacts to melt them via the intermediate insulating layer to create an electrical connection with the connection points. During this process, the connector is held in position under an applied pressure, which compresses the melting metallic contacts but does not compress the layers of insulating material. Adhesive may be applied around a peripheral edge of the connection zone (either on the connector or on the glazing) to provide a protective seal around the electrical connection.

Unfortunately a number of problems have arisen when applying such a connector to connection points on a glazing. Firstly, it has been observed that the metallic contact material (typically solder) may flow out of the apertures in the insulating layer in a capillary process, causing a short circuit and failure of the connector. This is unacceptable. Secondly, as the heating tool is applied, due to the heat and pressure that it imparts it has also been observed that the metallic contact material may splash as it melts forming discrete, visible particles of material between the apertures in the insulating layer. This is highly undesirable from an aesthetic point of view. Thirdly, because of the relative rigidity of the insulating layers, the connector does not appear to be suitable for use with curved glazings.

To reduce, and possibly eliminate, the occurrence of short circuits and splashing of the metallic material, it has been proposed to reduce the temperature and/or pressure imparted to the metallic contacts, and to reduce the volume of metallic material used for each contact. However, this leads to a further problem of an unreliable electrical connection between the contacts and the connection points due to inadequate thermal distribution in a reduced volume of contact material, meaning that the contact material does not melt properly and cannot fully fuse with the connections points.

With all of this in mind, it is therefore an object of the present invention to provide an improved electrical connector suitable for connection to an electrical element on a substrate, which does not suffer from the problems outlined above during and after its connection to the electrical element.

Accordingly, the present invention provides in a first aspect an electrical connector comprising:

a connector body having first and second connection portions and two or more electrical pathways provided within the connector body between the first and second connection portions, the first connection portion having a functional surface on which at least two exposed areas of conductive material are provided, each of which is in contact with a corresponding electrical pathway, for connection to an electrical element on a substrate, wherein adhesive is provided on the functional surface such that, at a minimum, a peripheral band is formed around each of the areas of conductive material for adhesion to the substrate.

Such a connector does not suffer from the problems associated with the prior art connector described in EP 1 439 600 A2 during and after its connection to a substrate, in that there is no extraneous flow of conductive material and so no short circuits are observed, and there are no observed instances of splashing of the conductive material. Furthermore, provision of a peripheral adhesive band around each of the conductive areas instead of use of further insulating material in this zone (as per the prior art connector of EP '600) means that the connector is relatively flexible, making it suitable for use with both flat and curved substrates, and an impermeable physical and electrical seal is provided around each conductive area.

The electrical element may comprise one or more connection points; the connector may cooperatively comprise a suitable number of areas of conductive material to correspond with the number of connection points. For example, if the electrical element includes three connection points, the connector may include three areas of conductive material. As for nature of the electrical element, this may be any functional device that requires connection to another device via an electrical connector.

Preferably the adhesive is provided as a layer around each of the areas of conductive material to maximise the amount of adhesion possible between the first connection portion of the connector and the substrate.

Advantageously the adhesive may be a compressible adhesive. During connection of the connector to the substrate, use of only moderate pressure with a heating tool applied directly onto the first connection portion allows for good thermal conductivity through this portion to reliably melt the conductive material and create a secure electrical connection with the electrical element on the substrate. Furthermore the adhesive bond to the substrate may be reinforced on application of moderate heat and pressure in this way.

The adhesive may be provided with a removable protective layer, which protects the adhesive from contamination and damage prior to the connector being connected to a substrate.

Preferably the adhesive has a thickness of 500 μm or less, further preferably 300 μm or less and most preferably 150 μm or less.

Each of the areas of conductive material preferably has a thickness less than the thickness of the adhesive. When the connector is positioned on a substrate such that each of the areas of conductive material overlies a connection point of an electrical element, it is preferably only the adhesive that contacts the substrate and not the conductive material. This ensures that when a heating tool is applied to the first connection portion of the connector, the adhesive bond between the connector and the substrate is cured, creating individual sealed spaces into which the conductive material may melt and flow without there being a risk of capillary flow between them and splashing of the material.

Thus each of the areas of conductive material preferably has a thickness of 200 μm or less, further preferably 150 μm or less and most preferably 100 μm or less. However such a thickness of conductive material is still more than adequate to ensure that a reliable electrical connection is made with connection points on the electrical element.

The conductive material may be solder. There are numerous lead-free and lead-containing solders known in the art, including one or more of materials such as tin, lead, copper, zinc, silver, bismuth, indium and antimony, any of which may be used. Advantageously the solder may be pre-fluxed with a reducing agent which is designed to help remove impurities (for example oxidised metal) from the connection points to improve the electrical connection. The flux may be of the "non-clean" type meaning that no cleaning of the solder contacts is required post-soldering.

Regarding the other components of the electrical connector, the connector body may be made from any suitable material such as polyimide, and the electrical pathways may be metallic tracks, such as copper tracks. The second connection portion may be a hub for enabling connection of the connector to another device.

According to a second aspect of the present invention there is also provided a glazing comprising:

at least one pane of glazing material provided with an electrical element, and an electrical connector according to the first aspect of the invention electrically connected to the electrical element and adhered to a surface of the glazing.

Use of such a connector means that during its connection to the glazing, the occurrence of short circuits and splashing of the conductive material comprised in the connector is substantially reduced, if not entirely eliminated. Furthermore, the glazing may be flat or it may be curved—in either case the connector is flexible enough to enable satisfactory connection of it to a surface of the glazing.

With regards to the connector, the thickness of each of the areas of conductive material is preferably substantially the same as the thickness of the adhesive. Although the thickness of the adhesive is greater than the thickness of each of the areas of conductive material prior to connection of the connector to the glazing, application of heat and pressure to the first connection portion of the connector by the heating tool ensures that a substantially uniform thickness is achieved for the conductive material and the adhesive.

Once the connector is connected to the electrical element, the force required to peel the adhesive from the surface of the glazing is preferably at least 10 N, further preferably at least 20 N and most preferably at least 30 N. The greater the force required, the stronger the adhesive bond between the connector and the surface of the glazing, which provides additional support to the electrical connection created between the conductive material of the connector and connection points of the electrical element of the glazing.

The glazing may be a monolith or it may be a laminate comprising two or more panes of glazing material joined together by one or more plies of interlayer material. If the glazing is a laminate, the electrical element may be provided either on the interior or the exterior of the laminate.

The one or more panes of glazing material may be panes of glass, preferably soda-lime-silica glass, which may be clear or body-tinted, or they may be panes of a rigid plastics material such as polycarbonate. Typically the panes of glazing material may be used in a thickness between 1 and 10 mm, preferably between 1.5 and 6 mm. The one or more plies of interlayer material may be a flexible plastics material, which may be clear or body-tinted, such as polyvinyl butyral, typically used in thicknesses of 0.76 mm or 0.38 mm.

A glazing according to the invention may especially be used as a vehicle glazing, which may be fitted into any window opening in the bodywork of a vehicle, such as a windscreen or a rear window glazing. For a vehicle glazing, the electrical element may be a functional device such as a busbar, an antenna, or the like.

For a better understanding the present invention will now be more particularly described by way of non-limiting example with reference to, and as shown in, the accompanying schematic drawings (not to scale) wherein.

Figure 1:
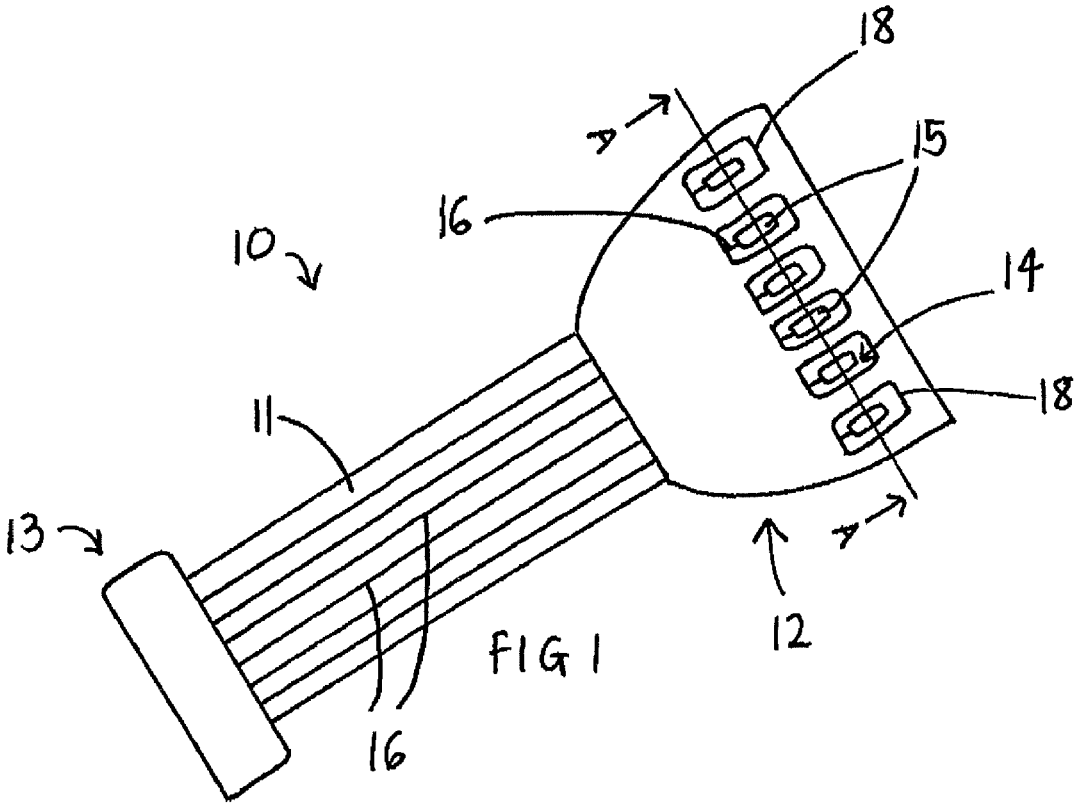
FIG. 1 is a plan view of an electrical connector according to the invention.

FIG. 1 shows electrical connector 10 which comprises connector body 11, at one end of which there is first connection portion 12 and at the other end there is second connection portion 13. First connection portion 12 is the portion which is capable of being connected (electrically and adhesively) to a substrate (not shown). Second connection portion 13 is in the form of a hub which is capable of being connected to an external device (not shown).

First connection portion 12 comprises functional surface 14 on which is provided six areas of conductive material, each in the form of a patch of pre-fluxed solder 15. Each solder patch 15 is electrically connected to an individual electrical pathway, in the form of a copper track 16, of which there are six—one for each patch of solder 15. Each copper track 16 extends from first connection portion 12 inside connector body 11 (where they are electrically insulated) to second connection portion 13.

Figure 2:
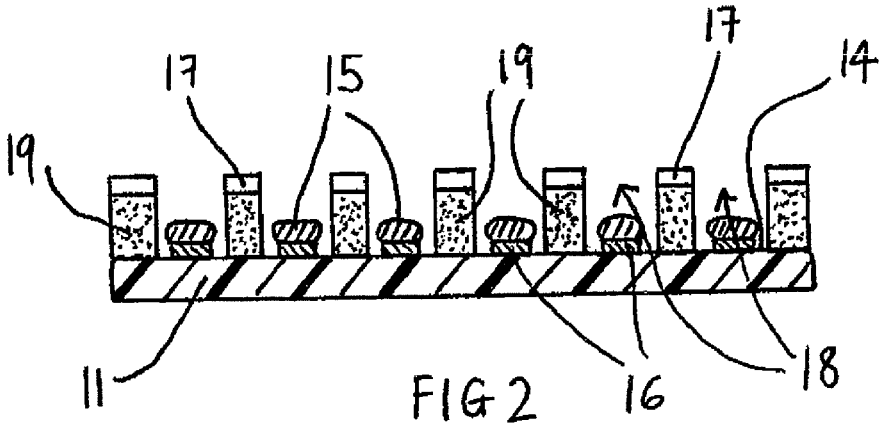
FIG. 2 is a cross section along line A-A of FIG. 1.

As shown in FIGS. 1 and 2, the top surface of first connection portion 12 ("top" with reference to the orientation shown in the figures) is covered with removable protective layer, in the form of backing paper 17, to protect underlying adhesive layer 19. Both backing paper 17 and underlying adhesive layer 19 are provided with six apertures 18 in register with one another (backing paper 17 being in situ when apertures 18 were stamped into adhesive layer 19). Adhesive layer 19 is provided on functional surface 14 such that a peripheral band is formed around each patch of solder 15.

Connector body 11 may be provided as a polyimide material, such as Kapton™ which is available from Du Pont (www.dupont.com). Adhesive layer 19 and corresponding protective backing paper 17 may be obtained from 3M (www.3m.com) as compressible adhesive 3M™ VHB™ Adhesive Transfer Tape F-9460PC, F-9469PC or F-9473PC. Adhesive layer 19 is typically around 130 μm in thickness, compared to the smaller thickness of 80-90 μm for each solder patch 15. The difference in thickness is illustrated in FIG. 2—it ensures that when connector 10 is attached to a substrate, adhesive layer 19 contacts and adheres to the substrate before solder patches 15 are able to flow.

Figure 3:
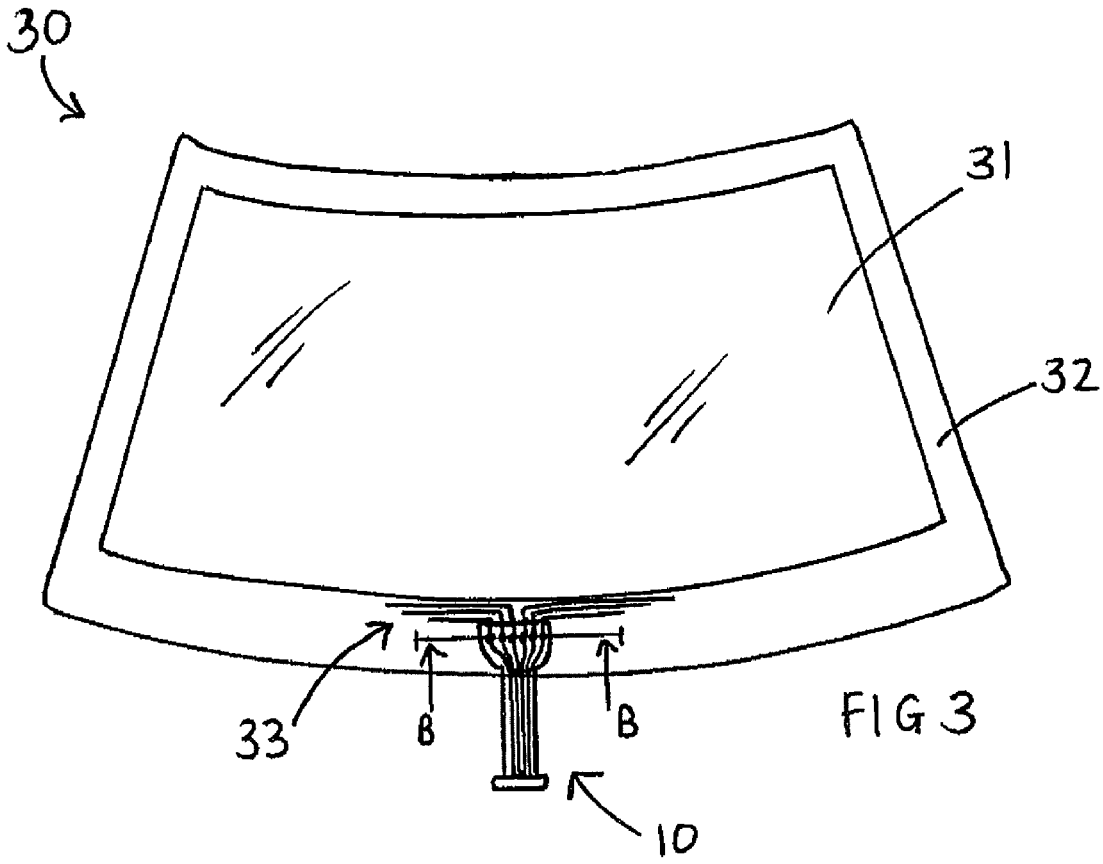
FIG. 3 is a plan view of a glazing according to the invention.
Figure 4:
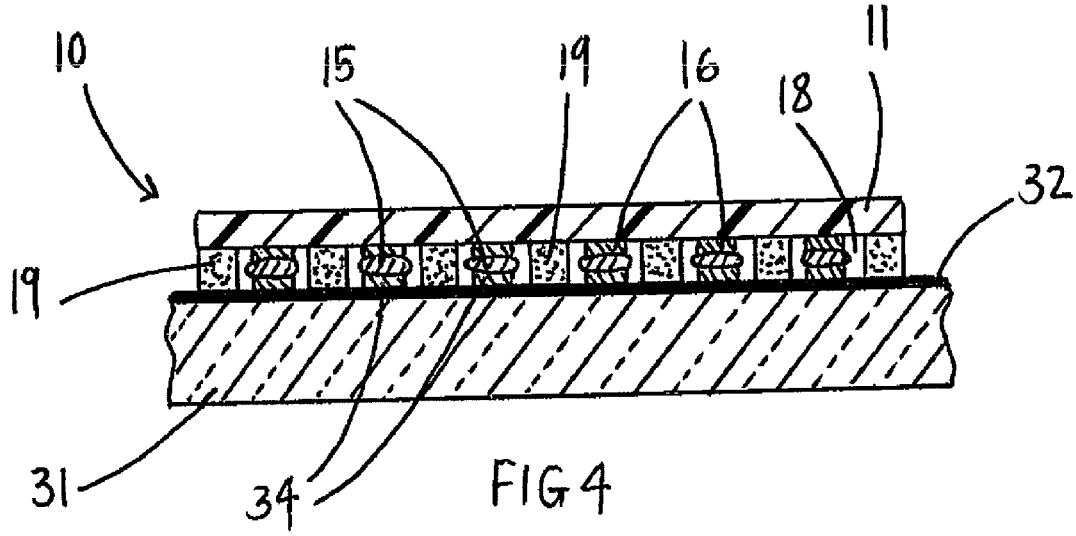
FIG. 4 is a cross section along line B-B of FIG. 3.

FIGS. 3 and 4 show glazing 30 to a surface of which an electrical connector 10 may be electrically and adhesively connected. Glazing 30 is in the form of a vehicle windscreen and it comprises a pane of glazing material, in the form of a pane of glass 31. Around the periphery of glass pane 31 there is an obscuration band 32, which is there to disguise and protect the sealant (not shown) that is used to fix glazing 30 into a vehicle (not shown). Obscuration band 32 is made from opaque ink that has been screen printed onto the glazing and subsequently fired. However, it may be composed of and applied using any other known means, or it need not be there at all.

At the bottom of glazing 30, on the surface that would face into a vehicle, electrical element, in the form of a series of conducting tracks 33, is provided. Each of the tracks in the series 33 terminates in connection point 34, of which there are six. Electrical connector 10 is attached to glazing 30 such that each of the six patches of solder 15 lies in register with one of the six connection points 34, with adhesive layer 19 forming physical and electrical barriers in between.

FIG. 4 shows adhesive layer 19 in contact with the obscuration band 32 on the surface of glazing 30 such that six sealed spaces are created with apertures 18. In making electrical connections between copper tracks 16 and connections points 34 solder patches 15 have flowed without creation of short circuits or unsightly splashing of the solder. When attached to glazing 30 as shown in FIGS. 3 and 4, the thickness of adhesive layer 19 is reduced as compared to its thickness prior to attachment such that its thickness is substantially the same as the thickness of each solder patch 15, which are also reduced to around 60 μm. The strength of the adhesive bond created between adhesive layer 19 and obscuration band 32 on the surface of glazing 30 is such that the force required to peel connector away from the glazing is around 30 N, thereby providing protection for the electrical connections.

The invention claimed is:

1. An electrical connector fixed to a vehicle glazing comprising:

a connector body having first and second connection portions and two or more electrical pathways provided within the connector body between the first and second connection portions, the first connection portion having a functional surface on which at least two exposed areas of conductive material are provided, each of which is in contact with a corresponding electrical pathway, for connection to an electrical element on the vehicle glazing, wherein adhesive is provided on the functional surface such that, at a minimum, a peripheral band is formed around each of the areas of conductive material, the adhesive being adhered to a surface of the vehicle glazing so that the electrical connector is fixed on the vehicle glazing.

2. An electrical connector fixed to a vehicle glazing as claimed in claim 1 wherein the adhesive is provided as a layer around each of the areas of conductive material.

3. An electrical connector fixed to a vehicle glazing as claimed in claim 1 wherein the adhesive is a compressible adhesive.

4. An electrical connector fixed to a vehicle glazing as claimed in claim 1 wherein the adhesive is provided with a removable protective layer.

5. An electrical connector fixed to a vehicle glazing as claimed in claim 1 wherein the adhesive has a thickness of 500 μm or less.

6. An electrical connector fixed to a vehicle glazing as claimed in claim 5 wherein each of the areas of conductive material has a thickness less than the thickness of the adhesive.

7. An electrical connector fixed to a vehicle glazing as claimed in claim 6 wherein each of the areas of conductive material has a thickness of 200 μm or less.

8. An electrical connector fixed to a vehicle glazing as claimed in claim 1 wherein the conductive material is solder.

9. An electrical connector fixed to a vehicle glazing as claimed in claim 8 wherein the solder is pre-fluxed.

10. An electrical connector fixed to a vehicle glazing as claimed in claim 1 wherein the thickness of each of the areas of conductive material comprised in the connector is substantially the same as the thickness of the adhesive.

11. An electrical connector fixed to a vehicle glazing as claimed in claim 10 wherein the force required to peel the adhesive from the surface of the glazing is at least 10 N.

12. An electrical connector fixed to a vehicle glazing as claimed in claim 2 wherein the adhesive is a compressible adhesive.

13. An electrical connector fixed to a vehicle glazing as claimed in claim 2 wherein the adhesive is provided with a removable protective layer.

14. An electrical connector fixed to a vehicle glazing as claimed in claim 3 wherein the adhesive is provided with a removable protective layer.

15. An electrical connector fixed to a vehicle glazing as claimed in claim 2 wherein the adhesive has a thickness of 500 μm or less.

16. An electrical connector fixed to a vehicle glazing as claimed in claim 4 wherein the adhesive has a thickness of 500 μm or less.

17. An electrical connector fixed to a vehicle glazing as claimed in claim 2 wherein the conductive material is solder.

18. An electrical connector fixed to a vehicle glazing as claimed in claim 7 wherein the conductive material is solder.

19. An electrical connector fixed to a vehicle glazing, the vehicle glazing comprising a pane of glass having a surface on which is provided a plurality of conducting tracks, the electrical connector comprising:

a connector body having first and second connection portions and a plurality of electrical pathways provided within the connector body between the first and second connection portions;

the first connection portion having a functional surface on which a plurality of spaced apart areas of conductive material are provided, each of the areas of conductive material being electrically connected to a corresponding one of the electrical pathways, and each of the areas of conductive material also being electrically connected to a corresponding one of the conducting tracks on the pane of glass; and adhesive adhered to the functional surface of the first connection portion and individually surrounding each of the areas of conductive material so that a portion of the adhesive is between each pair of adjacent areas of conductive material.

* * * * *